US005804775A

United States Patent [19]

Pinnington

[11] Patent Number: 5,804,775

[45] Date of Patent: Sep. 8, 1998

[54] LIGHT WEIGHT SHELL ACOUSTIC ENCLOSURE

[75] Inventor: Roger James Pinnington, Southampton, Great Britain

[73] Assignee: The Secretary of State for Defence in Her Britannic Majesty's Government of the United Kingdom of Great Britain and Northern Ireland, Hants, United Kingdom

[21] Appl. No.: 750,106

[22] PCT Filed: May 24, 1995

[86] PCT No.: PCT/GB95/01210

§ 371 Date: Nov. 26, 1996

§ 102(e) Date: Nov. 26, 1996

[87] PCT Pub. No.: WO95/33135

PCT Pub. Date: Dec. 7, 1995

[30] Foreign Application Priority Data

May 26, 1994 [GB] United Kingdom ..... 9410609

[51] Int. Cl.[6] ..... G10K 11/04

[52] U.S. Cl. ..... 181/200; 181/202; 181/204; 181/208

[58] Field of Search ..... 181/200, 202, 181/204, 205, 207, 208, 403; 417/312, 902

[56] References Cited

U.S. PATENT DOCUMENTS

| | | | |
|---|---|---|---|
| 4,190,131 | 2/1980 | Robinson | 181/207 X |
| 4,345,882 | 8/1982 | Saito et al. | 417/312 |
| 4,384,635 | 5/1983 | Lowery | 181/403 |
| 4,729,723 | 3/1988 | Outzen | 417/312 |
| 4,834,625 | 5/1989 | Grant . | |
| 5,272,285 | 12/1993 | Miller . | |
| 5,487,648 | 1/1996 | Alfano et al. | 417/312 |
| 5,538,404 | 7/1996 | DiFlora et al. | 417/312 |
| 5,588,810 | 12/1996 | DiFlora et al. | 417/312 |

FOREIGN PATENT DOCUMENTS

| | | |
|---|---|---|
| 1008559 | 7/1962 | United Kingdom . |
| 2057066 | 7/1980 | United Kingdom . |

*Primary Examiner*—Khanh Dang
*Attorney, Agent, or Firm*—Nixon & Vanderhye P.C.

[57] ABSTRACT

A lightweight acoustic enclosure (1.1), for the reduction of noise transmission from monopole, quadrapole and higher order noise sources via airborne paths at frequencies lower than the approximate ring frequency of the enclosure (1.1), comprising an approximately spherical shaped enclosure (1.1), which is made from stiff materials to reduce the amount of stretching of the enclosure wall and substantially encases the noise source, all structural paths between the enclosure and the noise source comprising vibration isolation (2.4). The thickness of the enclosure wall can be relatively thin. The enclosure (1.1) can comprise multiple concentric layers of stiff material, ideally with adjacent layers having at least one compliant layer, such as foam rubber, sandwiched between them. The enclosure (1.1) can comprise several component parts such as spherical shell elements (1.2), with radii less than that of the approximate radius of the enclosure (1.1). Additional webbings or flanges (1.3) can be included which either form part of or are used with the component parts to increase the stiffness in the enclosure (1.1). Suitable stiff material can be steel, aluminum, carbon fiber, fiber reinforced resins or any combination of these.

10 Claims, 5 Drawing Sheets

LIGHT WEIGHT SHELL ACOUSTIC ENCLOSURE

BACKGROUND OF THE INVENTION

1. Field of the Invention

The present invention relates to lightweight stiff acoustic enclosures.

2. Discussion of Prior Art

Noise generated by machinery may be transmitted to the surrounding environment by either structural or airborne paths. The structural paths comprise mounts, pipework or other mechanical connections. Once suitable vibration isolators have been attached to the structural paths, the airborne paths become the most significant route for noise transmission.

At present, the amount of noise transmitted by airborne paths is reduced with the use of acoustic enclosures. The performance of an acoustic enclosure is controlled by three aspects: the internal acoustic absorption; the sound transmission through the wall of the enclosure; and the mechanical links between the machine and the enclosure.

Internal acoustic absorption can be attained by using fibrous material for broadband absorption and Helmholtz resonators for narrow band absorption. The vibrational noise transmitted via mechanical links, such as pipework or mounts, can be isolated using vibration isolators. The sound transmission through the wall is controlled by several factors, mass per unit area being the most significant.

As a result, the relative mass of enclosures is invariably heavy, the weight of the enclosure often being in the same order of magnitude as the machinery itself in order to provide the required performance. The best performance of these types of enclosures is achieved at high frequencies, the performance deteriorating proportionally to frequency at low frequencies.

SUMMARY OF THE INVENTION

The object of this invention is to produce a light weight enclosure which produces significant noise reduction at low frequencies.

Accordingly, there is provided a light weight enclosure for the reduction of noise transmission for monopole, quadrapole and higher order noise sources via airborne paths at frequencies lower than the approximate ring frequency of the enclosure comprising an approximately spherical shaped enclosure which is made from stiff materials to reduce the amount of stretching of the enclosure wall and substantially encases the noise source, all structural paths between the enclosure and the noise source comprising vibration isolation.

It is preferable that all structural paths between the enclosure and the object to which it is mounted comprise vibration isolation.

The vibration isolation in the structural paths between the noise source and the enclosure ensures that the noise transmission from the noise source to the enclosure is only through the air within the enclosure. The vibration isolation prevents the vibrations of the noise source from being passed to the enclosure which, being stiff, would radiate the noise particularly well. The vibration isolation in the structural paths between the enclosure and the object on which it is mounted also helps prevent unwanted vibrations being passed to the enclosure.

Structural paths include mounts pipework or other mechanical connections.

At high frequencies, noise transmission through the walls of an enclosure is dependent on the amount of transversal flexing of the walls. The amount of transversal flexing is dependent on the mass per unit area of the wall. Therefore, the amount of transversal flexing can be reduced by raising the mass per unit area of the enclosure wall. However, at lower frequencies, the inventor has found that the amount of noise transmission through the wall is also dependent on the stretching of the walls of the enclosure. Therefore, by reducing the amount of stretching, the amount of noise transmission at low frequencies can be reduced. This is achieved by making the enclosure as stiff as possible.

Because noise transmission due to the stretching of the walls of an enclosure is dependent on the stiffness and not on the mass, the thickness of the enclosure wall can be made to be relatively thin. However, if desired, the enclosure could still be made to have a high mass per unit area as well as being stiff. By doing this, noise transmission through the enclosure would be reduced at both higher and lower frequencies.

The inventor has found that the approximate frequency below which stretching of the enclosure wall reduces noise transmission occurs is the ring frequency. The ring frequency for a spherical enclosure is the longitudinal wave velocity through the enclosure wall divided by the diameter of the enclosure while for a substantially spherical enclosure the ring frequency is the longitudinal wave velocity through the enclosure wall divided by the approximate diameter of the sphere. Therefore, the ring frequency is dependent on the material from which it is made and the size of the enclosure.

The enclosure can be made to be stiff in two ways. Firstly, by making the enclosure from material which is physically stiff. Secondly, by making the geometry of the enclosure as spherical as possible. Ideally, the geometry of the enclosure is that of a sphere. A sphere provides the stiffest possible geometry and therefore the greatest overall stiffness. The enclosure is most effective when it completely encases the noise source.

The inventor has found that this type of enclosure works for monopole, quadrapole and higher orders of noise sources. However, it does not work for dipole noise sources, which are caused, for example, by an enclosed machine oscillating transversly as a rigid body.

A monopole source operates by "breathing", its volume enlargening and then reducing. As the volume enlargens and then reduces, the air between the source and the enclosure becomes periodically compressed. When the air is compressed, pressure applied to the inner surface of the enclosure forces the wall of the enclosure outwards causing it to to be stretched. The periodic compression of the air will cause the enclosure to pulsate uniformly. The amount of pressure applied to the inner surface is dependent on the amount of the volume change of the source relative to the overall volume of air within the enclosure. Therefore, the amount of pressure applied is a function of the amplitude of the noise source. The periodic compression of the air forms the main method of noise transmission from the monopole noise source to the enclosure. The amount of noise transmitted through the enclosure is dependent on the amount of stretching that takes place. No transversal flexing occurs. Therefore, by increasing the stiffness of the enclosure the amount of stretching is reduced which in turn reduces the amount of noise transmitted.

For other noise sources which have higher order poles, the main method of noise transmission from the noise source to the enclosure at low frequencies is by the movement of the air being laterally pumped around inside the enclosure between the in and out phase parts of the noise source. Therefore, at these frequencies, the noise transmission from the noise source to the enclosure is controlled by the air mass. At higher frequencies, the air is unable to move fast enough around the inside of the enclosure between the in and out phases of the source. This results in the compression of air in various locations within the enclosure. This results in varying pressures being applied to different parts of the interior wall of the enclosure. Both at lower and higher frequencies, the enclosure wall flexes in and out in synchronisation with the changing pressures. At these frequencies, therefore. there is both transversal movement and lateral stretching of the wall. Therefore, the noise transmission through the enclosure is both controlled by the mass per unit area and its stiffness. The performance for a multipole source is similar to that of a monopole source; namely below the ring frequency the stiffness of the enclosure controls noise transmission, while the mass controls the noise transmission at higher frequencies.

The only exception to this is the dipole. A dipole source operates by translational motion, oscillating backwards and forwards. At both the higher and lower frequencies, the resulting movement of the enclosure is translational only. No lateral stretching of the enclosure wall occurs and therefore, noise transmission through the enclosure wall is only controlled by the mass per unit area.

An enclosure can comprise multiple concentric layers of stiff material. Each layer would act as a single enclosure. Therefore, the noise would successively attenuate as it passes through each of the layers. To improve the performance, at least one compliant layer could be sandwiched between each adjacent layer. One possible material from which the compliant layer could be made is foam rubber.

A practical method of realising the invention is to produce the enclosure from a set of component parts which, when connected together, would form the overall enclosure. One suitable design for the component parts is that of spherical shell elements. Spherical shell elements are formed from a layer of material which is shaped to form part of sphere. Ideally, the radii of these spherical shell elements is less than that of the approximate radius of the spherical enclosure. To simplify the design, all of the radii of the spherical shell elements are preferably the same.

An enclosure which is spherical in shape is not very practical. Most machines are rectangular or cubic in shape. The geometries of these two shapes are not particularly compatible, the largest cube being able to fit inside a sphere only occupying 36.75% of the volume.

By using an enclosure which comprises spherical shell elements, the amount of space wasted inside the enclosure is reduced. Spherical shell elements have the benefit over other shaped elements of being individually stiff in addition to forming an overall enclosure which is stiff. If their radii is less than that of the enclosure, they will also each possess a higher individual ring frequency than that of the enclosure. This can result in the enclosure having a larger frequency range in which the noise transmission can be stiffness controlled. However, as more spherical shell elements are used to form the enclosure, the more the walls of the enclosure will tend to resemble flat surfaces. This will lead to the increased probability of noise transmission by transversal vibrations of the enclosure wall rather than stretching.

One way of improving the bending stiffness between the component parts is with the use of webbings or flanges. These can either form part of or be used between the component parts. The stiffness of the enclosure can be increased by increasing the depth of the webbings or the size of the flanges. The webbings and flanges have the added advantage of being able to be used as a means of supporting either the enclosure or the noise source enclosed within it.

The frequency below which stretching of such an enclosure occurs is dependent on the ring frequencies of the individual component parts, the overall geometry of the enclosure and the size and nature of the webbings or flanges.

Each of the spherical shell elements could comprises multiple concentric layers of stiff material. Ideally, adjacent layers have at least one compliant layer sandwiched between them. One particular suitable type of material which can be used as a compliant layer is foam rubber.

Ideal materials which can be used to make such an enclosure are steel, aluminium, carbon fibre, fibre reinforced resins or any combination of these.

Further reductions in noise transmission can be obtained by producing an enclosure which comprises a plurality of concentrically positioned light weight enclosures.

BRIEF DESCRIPTION OF THE DRAWINGS

The invention will now be described by way of an example and with reference to the following drawing.

DETAILED DESCRIPTION OF PREFERRED EMBODIMENTS

An experiment was carried out to measure the reduction in the amounts of noise radiated from an air compressor, 2.1, placed inside a stiff enclosure, 1.1. The experimental noise measurements were carried out in a reverberation chamber (not shown).

Figure 1:
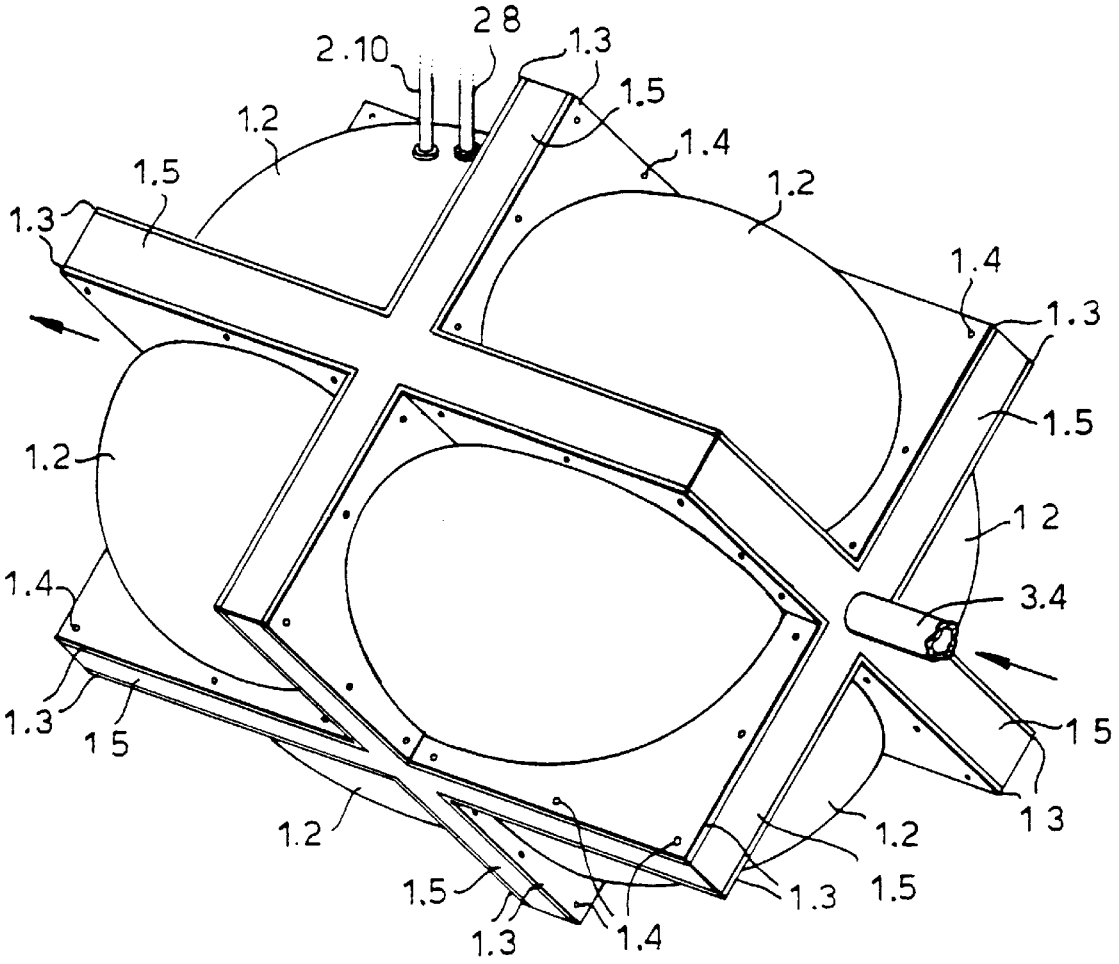
FIG. 1 shows a light weight acoustic enclosure which comprises eight identical spherical shell elements, the radii of curvature of each of the elements being less than that of the approximate diameter of the enclosure.

The enclosure for the air compressor was formed using eight part spherical shell elements, 1.2. See FIG. 1. The shell elements, 1.2, were made from glass reinforced polyester which had the fibres within the glass reinforced polyester randomly orientated. The shell elements, 1.2, were between 2 and 3 mm in thickness and had a radius of 100 mm. The shell elements, 1.2, were formed with flanges, 1.3, in order to produce extra stiffness within the enclosure, 1.1. This also resulted in a more practical shape for connection with other shell elements. The shell elements, 1.2, were connected together using bolts, 1.4, which were applied uniformly around the flanges, 1.3. This provided a useful means of interconnection which was not only stiff and air tight but one that could be swiftly dismantled.

Figure 2:
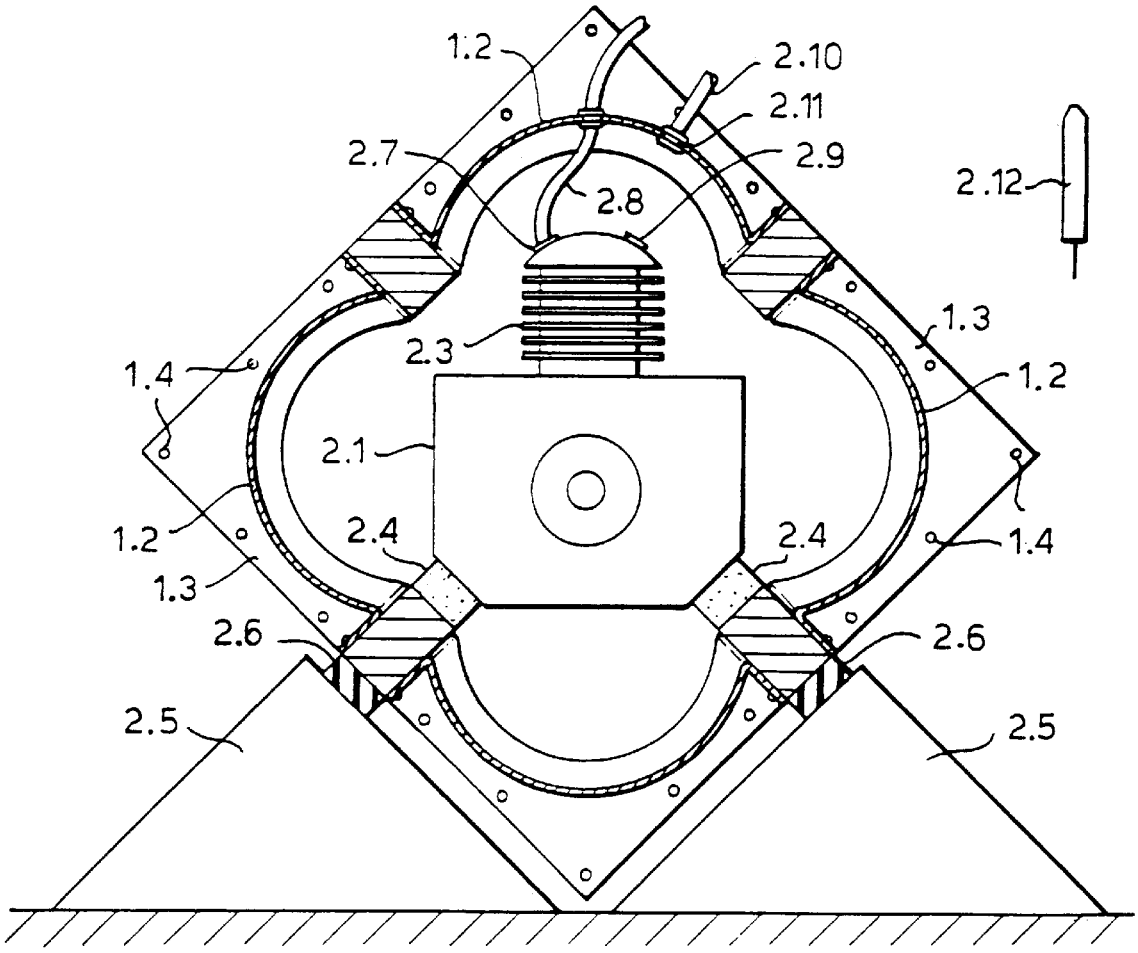
FIG. 2 shows a cross section of the enclosure with an electrically driven compressor inside, the direction of the cross section being across the width of the compressor.

Medium density fibreboard (MDF) spacers, 1.5, were sandwiched between the spherical shell elements, 1.2. The fibreboard spacers, 1.5, were inserted in order to provide a connection point for mounts which connect the compressor, 2.1, to the enclosure, 1.1, and for the mounts which connect the enclosure, 1.1, to the ground, 2.2. See FIG. 2 for a cross section view of the enclosure, 1.1, with the compressor, 2.1, inside. The spacers, 1.5, served no acoustic purpose but were included to make the correct space for accommodating the air compressor, 2.1.

Figure 3:
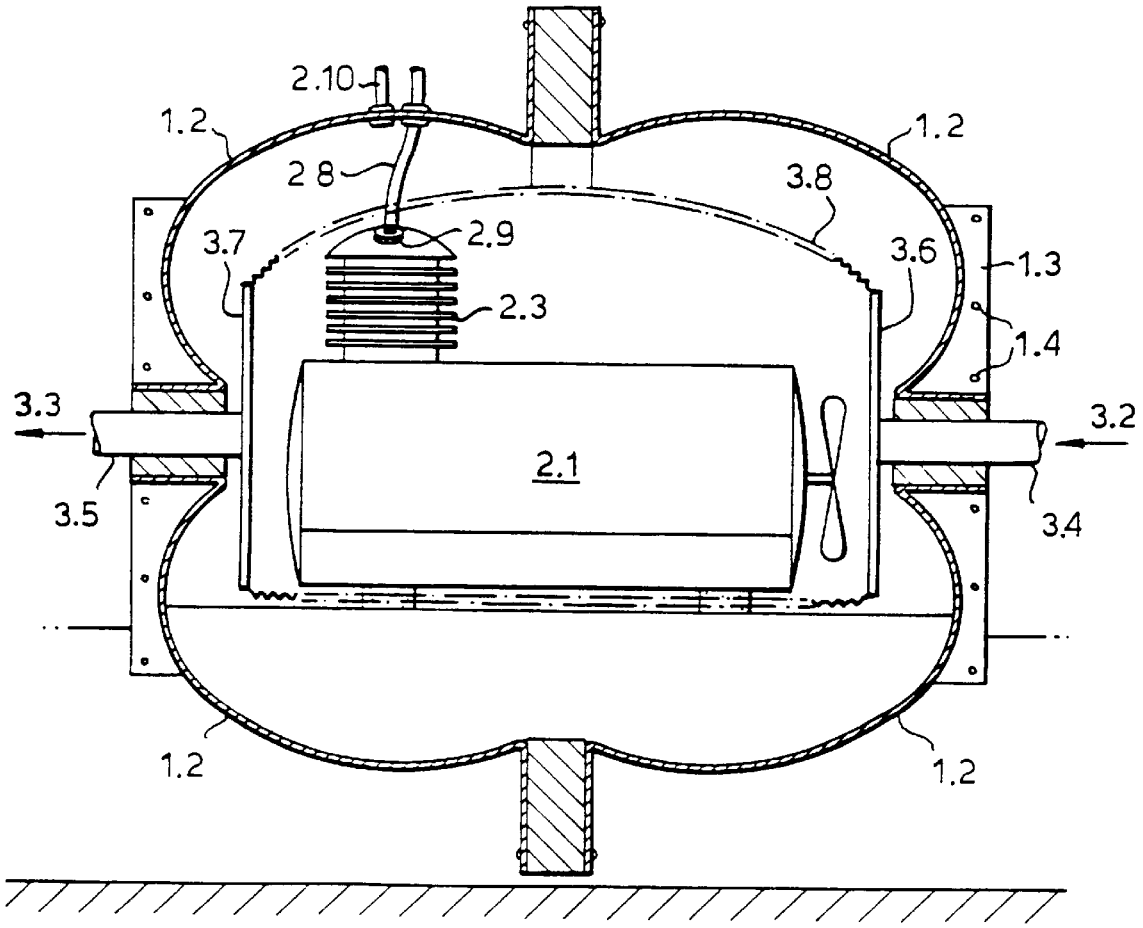
FIG. 3 shows a cross section of the enclosure with the compressor inside, the direction of the cross section being along the length of the compressor.

The air compressor, 2.1, was electrically driven and comprised a single compression cylinder, 2.3. The compressor acted as the noise source, producing a noise output which was equivalent to a combination of multipole sources. The compressor, 2.1, was cooled by air which was drawn across the compressor. 2.1, by a fan, 3.1. See FIG. 3. An inlet port, 3.2, for cooling air in the enclosure wall was located along the axis of the cooling fan, 3.1. Similarly, an outlet port, 3.3, for the cooling air was located along the axis of the fan, 3.1, opposite to the inlet port, 3.2. The cooling air passed through the inlet and outlet ports, 3.2, 3.3, via 12 mm bore steel pipes, 3.4, 3.5, which protruded 80 mm from the enclosure, 1.1. The cooling air inside the enclosure, 1.1, was guided closely around the compressor, 2.1, using two aluminium disks, 3.6, 3.7, and paper towelling, 3.8. The aluminium disks, 3.6, 3.7, and the paper towelling, 3.8, are only shown in FIG. 3. The paper towelling, 3.8, was sufficiently thin to allow sound to travel through it. The harmonics were expected to be multiples of 50 Hz due to the frequency of the electricity supply. The compressor, 2.1, weighed approximately 5 Kg.

The compressor, 2.1, was supported on mounts which were angled at 45°. The mounts were connected to the MDF spacers, 1.5, of the enclosure, 1.1. Each mount comprised an isolator, 2.4, made from rectangular block of expanded neoprene. The dimensions of the block were 30×30×30 mm. The dynamic stiffness at 10 Hz was $8\times10^4$ $Nm^{-2}$ which gives a Youngs modulus of $5\times5$ $Nm^{-2}$. The compressor had a resonant frequency of 15 Hz when supported by these mounts.

The enclosure, 1.1, was supported on mounts which connected to 45° external mounting blocks, 2.5, which were connected to the ground, 2.2. Each mount comprised an isolator, 2.6. Each isolator, 2.6, was made from a rectangular block of rubber and had a vertical stiffness of $3\times10^5$ $Nm^{-1}$.

The air for the compressor, 2.1, was fed to the air intake, 2.7, of the compressor, 2.1, by a rubber pipe, 2.8, which passed through the wall of the enclosure, 1.1, and connected to the compressor, 2.1. The air from the output, 2.9, of the compressor, 2.1, was fed directly into the enclosure, 1.1. This was to ensure that the compressor, 2.1, was noisy. The vigourous pressure pulsations from the output, 2.9, would raise the internal sound pressure. This was to ensure that the sound transmitted through the enclosure wall was above the background noise levels in order for meaningful experimental results to be taken. The air pressure pulsations also had the benefit of producing a strong monopole element in the noise generated, thereby producing a suitable noise source to test the theory.

Another pipe, 2.10, outside of the enclosure was connected to a hole, 2.11, in the enclosure wall. The compressed air generated would pass through this hole and was directed away from the enclosure through the pipe, 2.10. Both rubber pipes, 2.8, 2.10, had a 6 mm bore. The length of air intake pipe, 2.8, inside the enclosure was used to attenuate the the vibration transmission from the compressor, 2.9, to the enclosure, 1.1, via the pipe, 2.8. Both ends of the pipes, 2.8, 2.10, were placed outside of the reverberation chamber in order to prevent the pulses of air being sucked in and expelled from affecting the noise measurements. However, the rubber pipes, 2.8, 2.10, still radiated a small amount of noise in the reverberation chamber due to the pressure pulsation.

A B & K microphone, 2.12, type 4133 was placed on the plane of the enclosure horizontal axis 0.5 m away. This was used to measure the noise being radiated from the compressor, 2.1, with and without the enclosure, 1.1.

The noise generated by the compressor, 2.1, was measured for the following conditions: with the enclosure, 1.1, open and closed; and with the enclosure, 1.1, open and closed when the cooling ports, 3.2, 3.3, were blocked.

The enclosure, 1.1, was open when three quarters of it was removed. The last quarter was left because it formed part of the mounting structure for the compressor. The results obtained when the enclosure was open would be the same as if all of the enclosure was removed. It was closed when all of the segments, 1.2, were present and in place to form the enclosure and the compressor, 2.1, was sealed within it.

Figure 4:
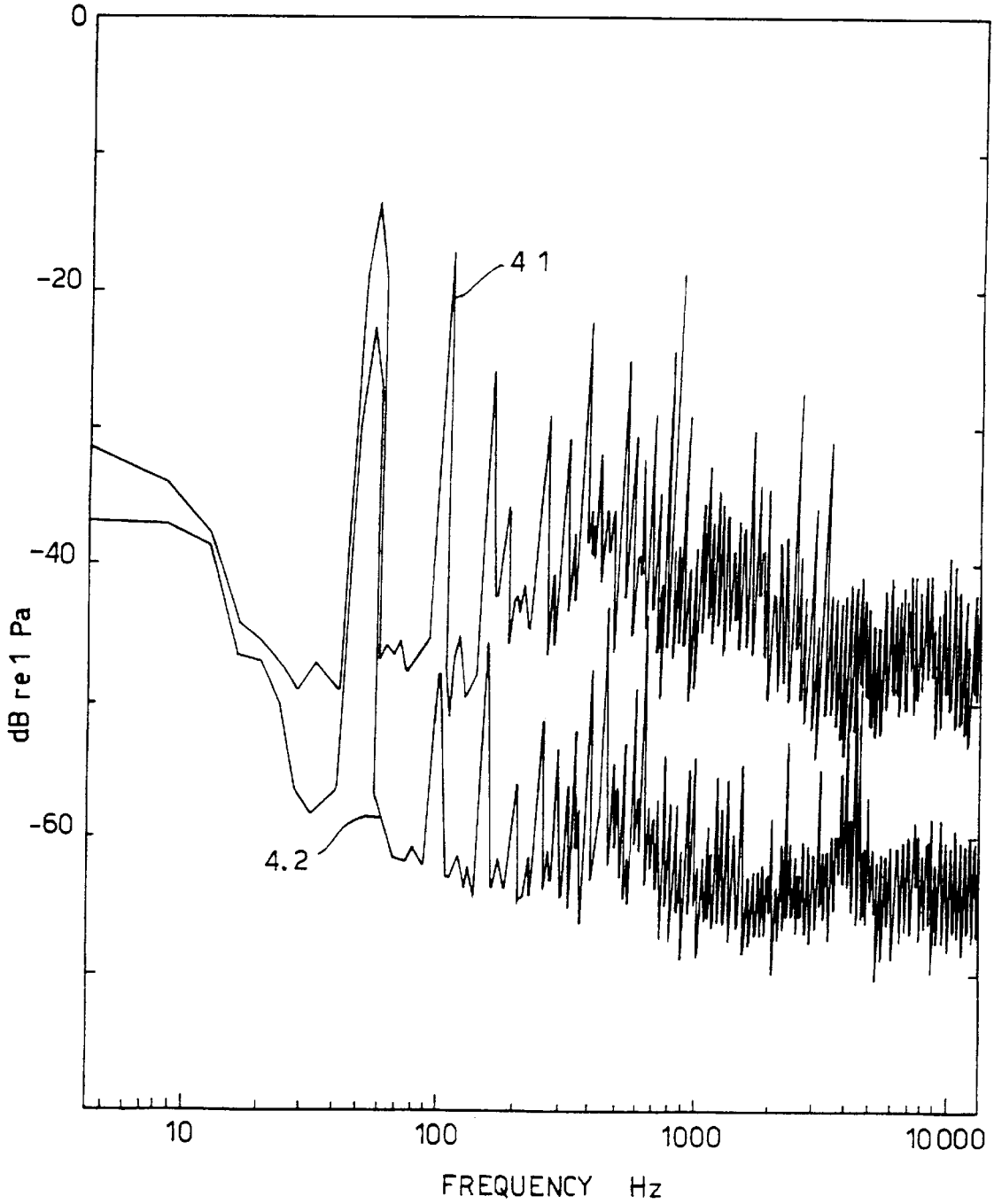
FIG. 4 shows the noise generated by the compressor with the enclosure open and with it closed.

FIG. 4 shows the noise generated with the enclosure open, 4.1, and with it closed, 4.2. Most tones are reduced by 20 dB to 30 dB with a few as much as 40 dB. The reductions are far greater than those which are are attributable to the reduction due to mass per unit area. Even at 50 Hz where there is a resonant frequency and therefore was likely to generate most translation movement of the enclosure there is still a 10 dB drop in the noise level.

Figure 5:
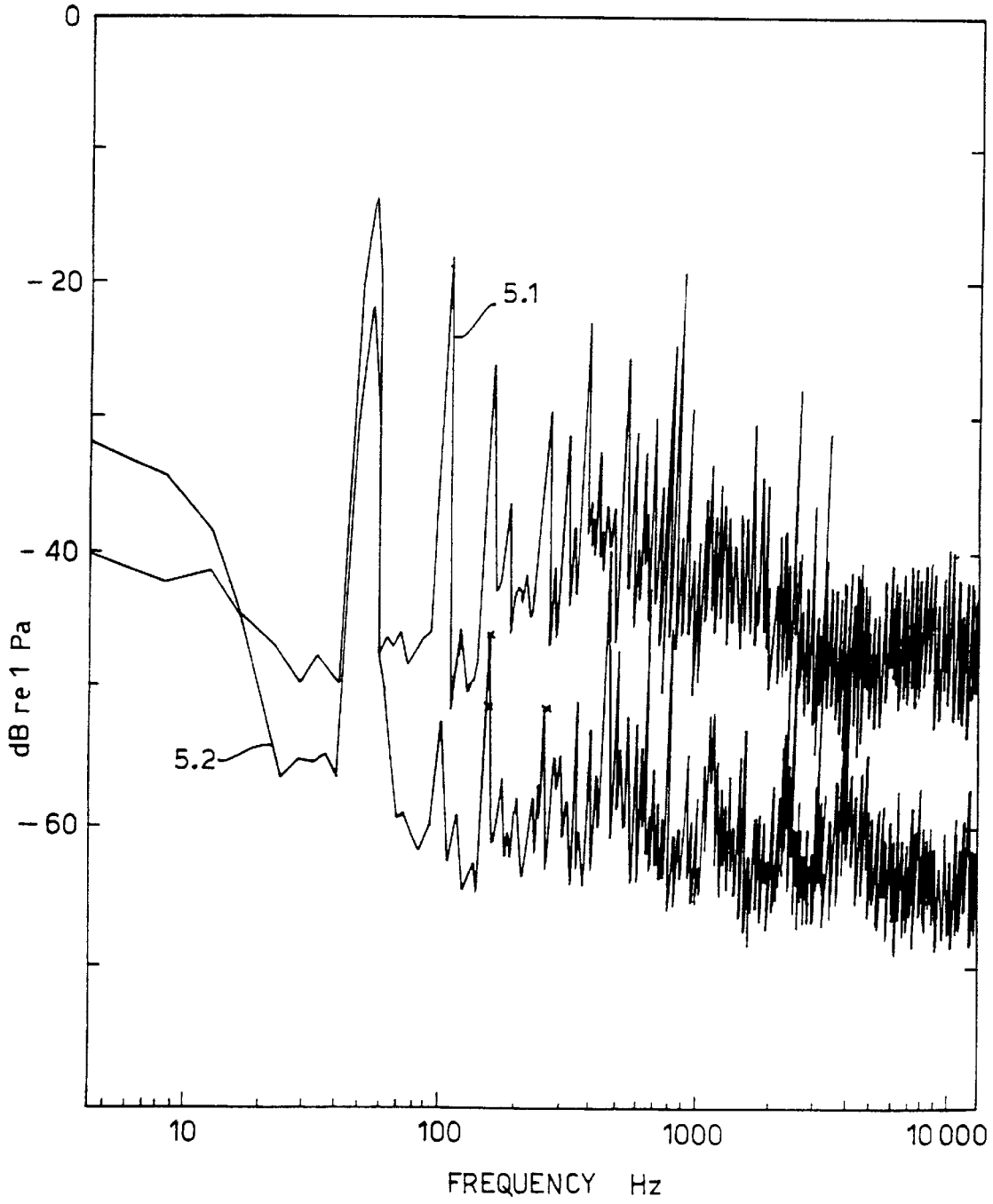
FIG. 5 shows the noise generated by the compressor with the enclosure open and with it closed, both with the cooling ports closed.

FIG. 5 shows the noise generated with the enclosure open, 5.1, and closed, 5.2, with the cooling ports, 3.2, 3.3, closed. The effect of blocking the cooling ports, 3.2, 3.3, of the enclosure is to reduce the noise above 800 Hz.

I claim:

1. A light weight acoustic enclosure for the reduction of noise transmission through the air from noise sources having monopole, quadrapole and higher order poles at frequencies lower than an approximate ring frequency of the enclosure; wherein the enclosure comprises a plurality of spherical shell elements connected together to form a hollow enclosure, said hollow enclosure encases said noise source, further including structural vibration isolation means between said noise source and said enclosure; wherein each spherical shell element comprises a stiff material such that stretching of the enclosure is reduced; and wherein each spherical shell element has a radius less than an approximate radius of the enclosure.

2. A light weight acoustic enclosure as claimed in claim 1, wherein all of the radii of the spherical shell elements are the same.

3. A light weight acoustic enclosure as claimed in claim 1, wherein webbings or flanges are included which either form part of or are used with each spherical shell element to increase the stiffness of the enclosure.

4. A light weight acoustic enclosure as claimed in claim 3, wherein the webbings or flanges form part of an attachment means for attaching the noise source to the enclosure.

5. A light weight acoustic enclosure as claimed in claim 3, wherein the webbings or flanges form part of an attachment means for attaching the enclosure to an object on which it is mounted.

6. A light weight acoustic enclosure as claimed in claim 1, wherein the spherical shell elements comprise multiple concentric layers of stiff material.

7. A light weight acoustic enclosure as claimed in claim 6, wherein adjacent layers have at least one compliant layer sandwiched between adjacent layers.

8. A light weight acoustic enclosure as claimed in claim 7, wherein the compliant layer is foam rubber.

9. A light weight acoustic enclosure as claimed in claim 1, wherein the stiff material is steel, aluminium, carbon fibre, fibre reinforced resins or any combination of these.

10. A light weight acoustic enclosure formed from a plurality of concentrically positioned light weight acoustic enclosures as claimed in claim 1.

* * * * *